United States Patent [19]

Belbel et al.

[11] Patent Number: 4,650,937

[45] Date of Patent: Mar. 17, 1987

[54] AUTOMATIC PROTECTION SWITCH WITH VISIBLE DISCONNECTING ACTION AND MANUAL RESETTING

[75] Inventors: Elie Belbel, Epinay sur Seine; Christian Blanchard, Nanterre; Jacques Cohen, Fontaine; André Haury, Le Raincy; Michel Lauraire, Courbevoie; Luc Moreau, Dijon, all of France

[73] Assignee: La Telemecanique Electrique, France

[21] Appl. No.: 666,084

[22] PCT Filed: Feb. 3, 1984

[86] PCT No.: PCT/FR84/00024

§ 371 Date: Oct. 4, 1984

§ 102(e) Date: Oct. 4, 1984

[87] PCT Pub. No.: WO84/03173

PCT Pub. Date: Aug. 16, 1984

[30] Foreign Application Priority Data

Feb. 8, 1983 [FR] France ..... 83 02273

[51] Int. Cl.[4] ..... H01H 15/18

[52] U.S. Cl. ..... 200/77; 200/153 LA; 200/50 A; 200/61.19; 200/153 M

[58] Field of Search ..... 200/153 M, 77, 61.19, 200/61.61, 61.62, 50 A, 293, 153 L, 153 LA, 153 LB

[56] References Cited

U.S. PATENT DOCUMENTS

| | | | |
|---|---|---|---|
| 1,599,764 | 9/1926 | Heller | 200/50 A |
| 1,826,370 | 10/1931 | Schwarz et al. | 200/50 A |
| 2,357,853 | 9/1944 | Smith | 337/110 |
| 3,030,470 | 4/1962 | Aargreaves | 335/27 |
| 3,054,880 | 9/1962 | Harman, Jr. | 200/293 |
| 3,842,228 | 10/1974 | Green | 200/61.19 |

FOREIGN PATENT DOCUMENTS 1541810 10/1968 France .

*Primary Examiner*—Charles E. Phillips
*Assistant Examiner*—Linda J. Shull
*Attorney, Agent, or Firm*—William A. Drucker

[57] ABSTRACT

An electric switch apparatus for protecting an electric circuit, said apparatus comprising a case, a pivoting drawer connected to the case and adapted to be manually pivoted from a closed position to an open position and reversely, a switch having a fixed and a movable contact, the movable contact being mechanically linked to the drawer for simultaneous opening therewith and a breaking member for automatically breaking an electric circuit connected across two terminals of the case, the said breaking member operating in case of an overflow of current in the said circuit, the movable contact being able to be separated from the fixed contact under the action of an actuation member comprising a spring and a magnetizable member, said actuating member cooperating with a coil placed in the circuit and being reset during a manual opening and closing movement of the drawer.

5 Claims, 16 Drawing Figures

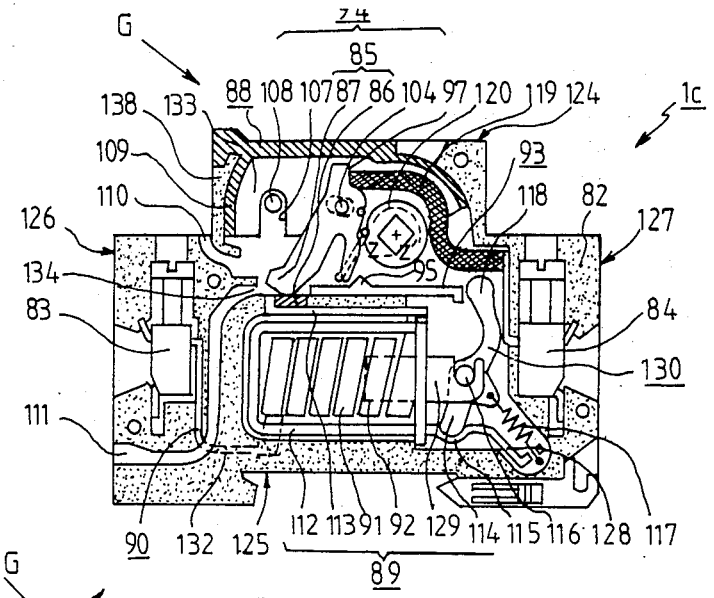
FIG. 11
FIG. 12
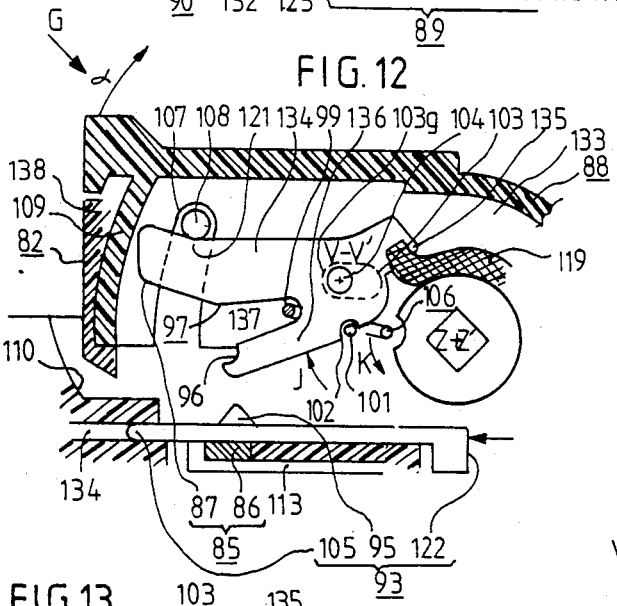
FIG. 13
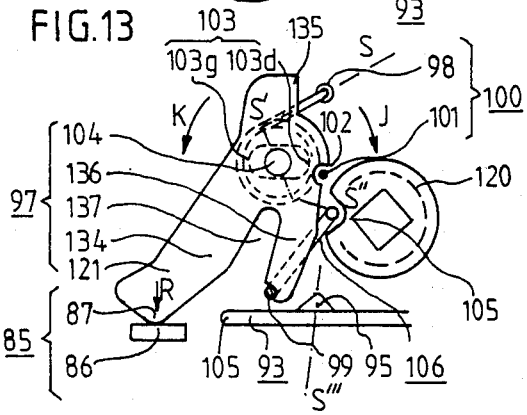
FIG. 14
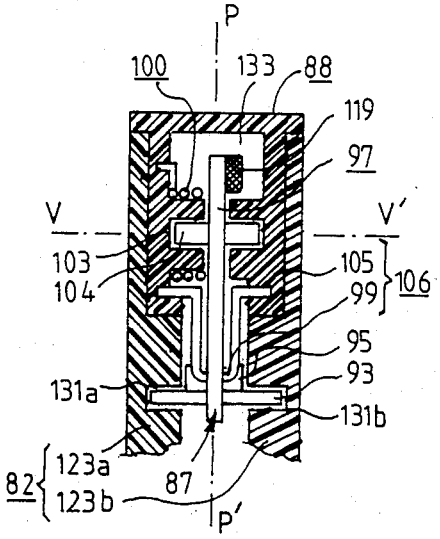

AUTOMATIC PROTECTION SWITCH WITH VISIBLE DISCONNECTING ACTION AND MANUAL RESETTING

Apparatus of the type described are used for protecting lines and, when they are disposed in narrow modular cases, are then frequently fitted to household distribution boxes.

A protection apparatus is already known, for example from DAS No. 2618360, having the general construction mentioned above, in which the protection switch is represented by a removable fuse cartridge and in which the isolating switch is placed in an internal region of the case distant from the front face. Such an apparatus has the double disadvantage of requiring the fuse cartridge to be changed after the appearance of a short circuit and not to indicate with certainty to the user if the isolating switch has indeed fulfilled its function; in fact, transmission means which are placed between the pivoting lid and a switch pusher undergo, when the breaker contacts are welded together, buckling forces which are so high that breakage thereof may be feared as well as maintenance thereof in the closed condition whereas, from the position of the drawer, it may be thought that they are in the open position.

U.S. Pat. No. 3,030,470 also concerns a protection apparatus comprising a fixed case provided with a fixed contact and a pivoting and manually operated lid pivotably connected to the fixed case and provided with a movable contact, the case and the lid comprising magnetothermal means for opening said movable contact.

This apparatus however does not allow the operator to make sure, in a simple and efficient manner, that the contacts have really been separated during magnetic or thermal tripping or during manual opening of the drawer.

The invention proposes consequently providing a protection apparatus which has none of the above mentioned defects. According to the invention, the desired result is obtained because the movable contact of the switch is carried by the drawer so as so be separated from the fixed contact by a sufficient disconnecting distance "d" when the drawer is manually opened, the movable contact being visible from outside.

Protection apparatus are already known such as cut out switches in which one and the same mobile contact may be opened either by automatic means, or by a manual control member which also allows resetting to be effected; these apparatus do not generally have an opening distance for contacts capable of conferring thereon the disconnecting properties which are desirable, and further do not make the position of the mobile contact visible from outside the case. In one embodiment of the invention, particularly advantageous when its application relates to protection apparatus in modular cases used in household installations, an insulating screen propelled between the contacts is used for its simplicity and excellent limiting properties.

In other advantageous embodiments of the invention, a single break mobile contact will be associated with the internal electric circuit by means which confer thereon total isolation so as to avoid the danger of accidental contact therewith by an operator.

The invention, the features which it presents and the measures taken for implementing same will be better understood from the following description.

In the accompanying drawing:

FIGS. 1*a*, 1*b*, 1*c* show schematically the constructions of three embodiments of the invention;

FIG. 11 illustrates a third embodiment of the switch according to the invention in an elevational view and in section through a median plane, where the switch is closed;

FIG. 12 shows a detail of the switch of FIG. 11 in the open position and after automatic opening;

FIG. 13 shows a detail of the switch according to FIG. 11 in the closed position; and FIG. 14 shows, in a partial left hand view in broken section of the case through the planes SS' S'' and S''' of FIG. 13, a detail of the resilient device causing opening of the switch.

Figure 1A:
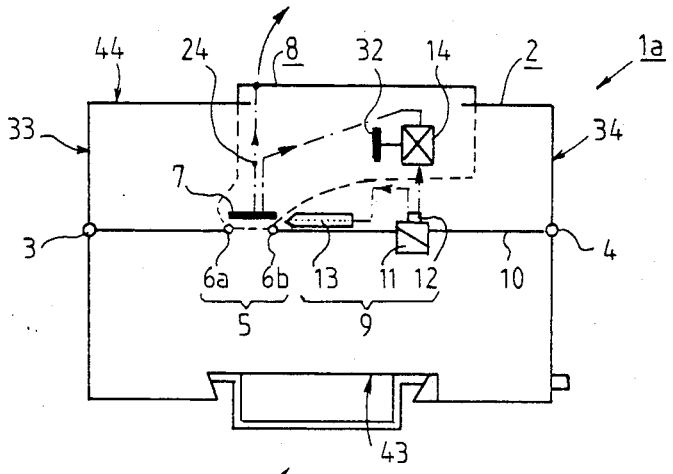

A first apparatus in accordance with the invention, which is shown schematically in FIG. 1*a*, comprises a case 2 having a front face 44 and a rear face 43 provided for example with securing means cooperating with standardized shaped sections.

Between two current input and output terminals 3, 4 placed in the vicinity of faces 33, 34, is disposed an electric circuit 10 comprising in series: a switch 5 having a mobile contact 7 and two fixed contacts 6*a*, 6*b*, as well as an automatic opening device 9 comprising a coil 11, a magnetizable core or plate 12 with which is associated an insulating screen 13 adapted to be propelled by this core between the contacts 7 and 6; a resilient device 14 for the rapid opening of the mobile contact 7 of switch 5 is tripped by the movement of the core or of the screen when a high over current flows in the circuit and so that the contacts of switch 5 are scarcely open when the screen moves therebetween.

Figure 3:
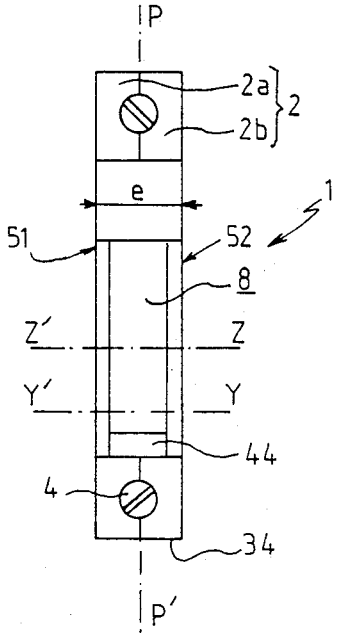
FIG. 3 shows, in a view from the left hand side, the apparatus shown in FIG. 2.

A drawer 8, mobile on the front face 44, has coupling means 24 allowing it to open switch 5 voluntarily by acting on the mobile contact 7; this same drawer when it opens makes the position of this mobile contact visible so that the user may, on the one hand, be sure that the line is electrically isolated and may, on the other hand, reset the device 14 when this latter has been tripped automatically. Referring to FIG. 3, which shows a particular embodiment of the invention of FIG. 1*a*, where a single pole switch is disposed in a modular case 2 of small modular width "e", equal for example to 8.5 mm, the terminals 3 and 4 are placed in a median plane PP' parallel to two lateral faces 51, 52 belonging respectively to two half cases 2*a*, 2*b* joined together along a joining plane contained in the plane PP'.

Figure 2:
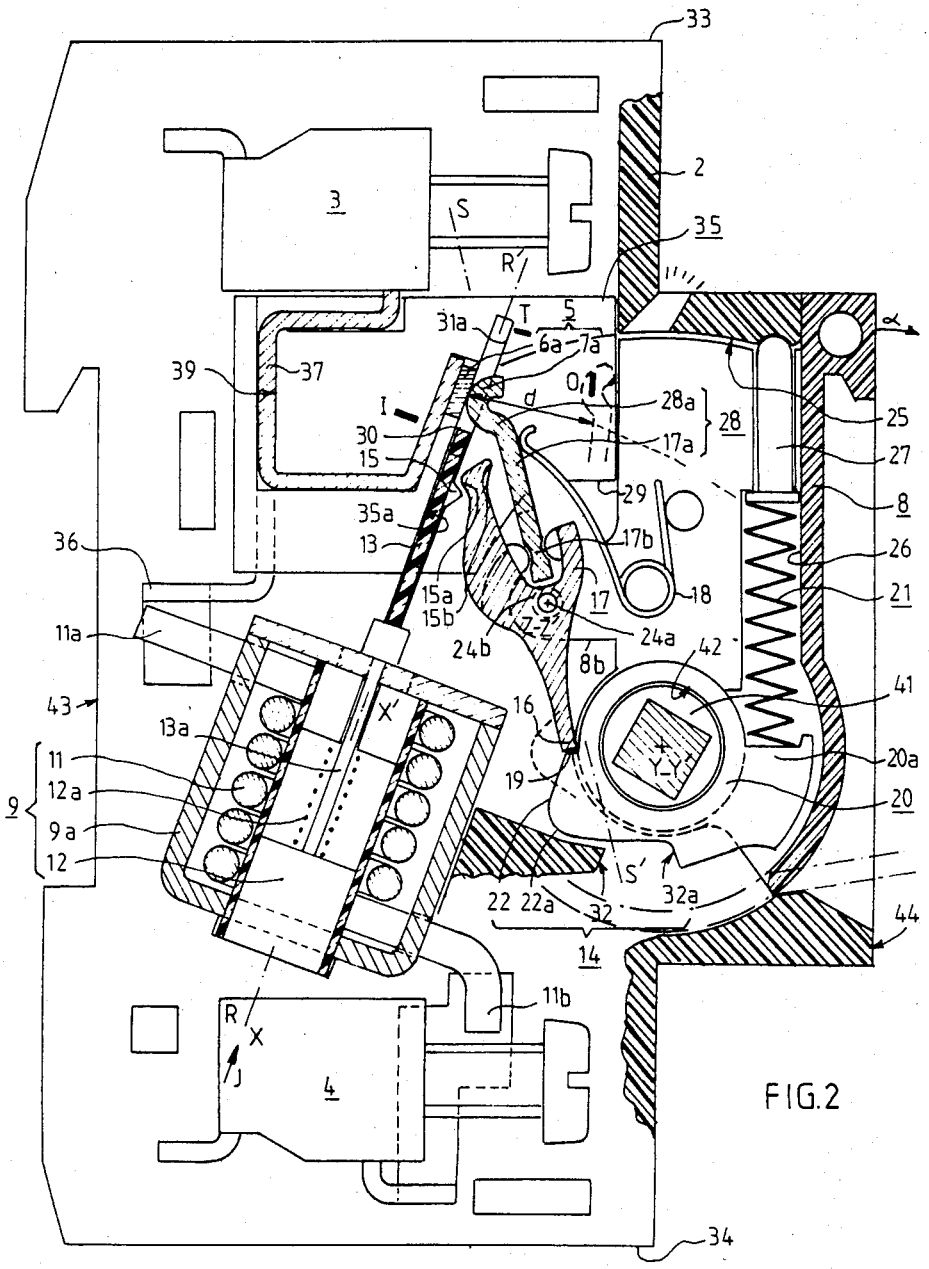
FIG. 2 shows in elevation and in section through the plane PP' of FIG. 3, a first embodiment of the invention using an insulating screen and a double break contact.
Figure 5:
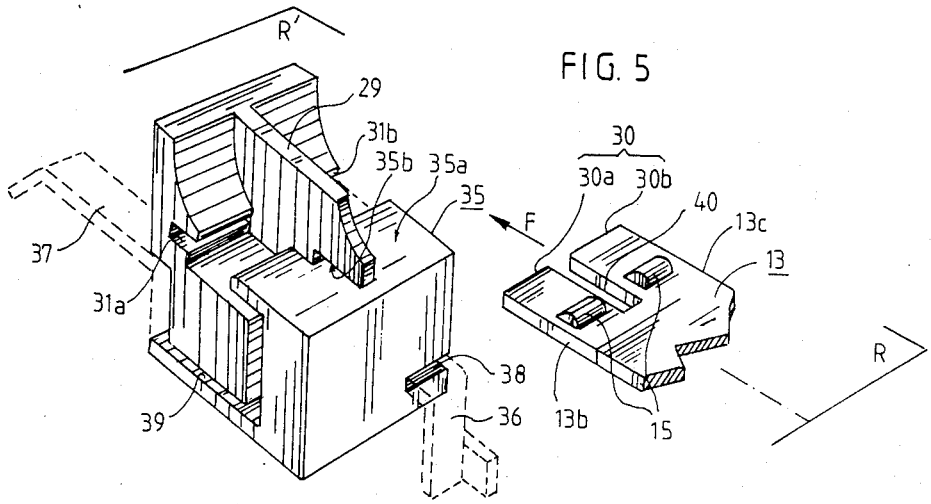
FIG. 5 shows, in a partial perspective view, the means used for accelerating cutting off of the arc.

The component elements of circuit 10, which are shown in FIG. 2, comprise a bent conductor 37, connected at one end to terminal 3 and carrying at its other end a fixed contact piece 6*a*. An intermediate part of the conductor is held in a groove 39 in an insulating block 35, which can be better seen in FIG. 5, which comprises another opposite groove 38 adapted to receive one end of a bent conductor 36 on which is placed a second fixed contact piece 6*b*; an insulating dividing wall 29 of this block separates the two fixed contacts.

Conductor 36 is moreover connected to one end 11*a* of the winding of coil 11, this latter cooperating with a magnetizable yoke 9*a* and with a magnetizable plunger core 12 to which a spring 12*a* gives a reset position "I" shown in FIG. 2; the other end 11*b* of the coil 11 is connected to terminal 4.

Figure 4:
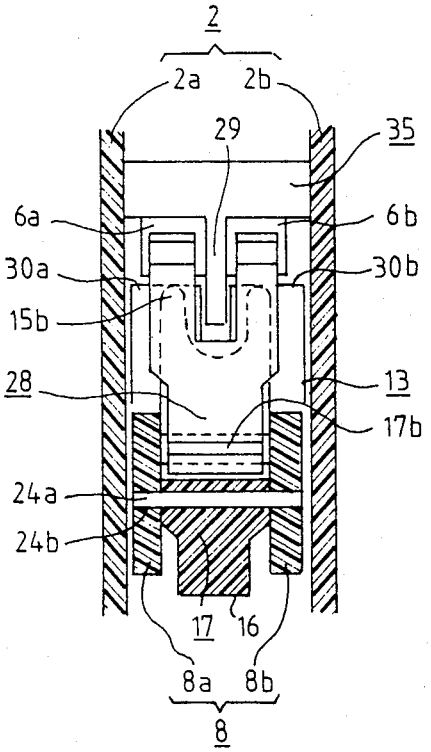
FIG. 4 illustrates a view of the apparatus of FIG. 2 in a partial sectional view through the plane SS'.

A contact bridge in the form of a fork 28 carries two mobile contact pieces 7*a*, 7*b* placed at the ends of legs 28*a*, 28*b* and is held in position with angular clearance by an insulating contact holder 17 adapted for pivoting about an axis ZZ' perpendicular to the plane of the Figure. For this purpose, the contact holder has a swivel pin 24*a* which is engaged in two bearings 24*b* placed in parallel flanges of a pivoting drawer 8, such as those shown at 8*a*, 8*b* in FIG. 6 and in FIG. 4.

The cooperation between the fixed and mobile contacts is ensured by means of a spring 18 which exerts a contact pressure by bearing on a point 17*a* of the mobile contact 28, the legs of the fork 28*a*, 28*b* being placed on each side of the dividing wall 29.

The contact holder 17 further comprises a heel portion 15*a* placed in the vicinity of the contact pieces 7A, 7*b* and a nose portion 16 which is opposite thereto. In the normal condition of the apparatus in which switch 5 is closed, nose 16 bears on an abutment surface 19 of a piece 20 adapted for pivoting about an axis YY' parallel to ZZ'. This piece which further comprises an inclined ramp or cam surface 22 ending at the abutment surface 19, also comprises a surface 32*a* adapted to cooperate in a certain angular position with a bearing surface 32 of case 2, and a radial arm 20*a* receiving the clockwise thrust of a compression spring 21; the thrust of this spring is counterbalanced by the action of the nose portion against surface 19.

Figure 6:
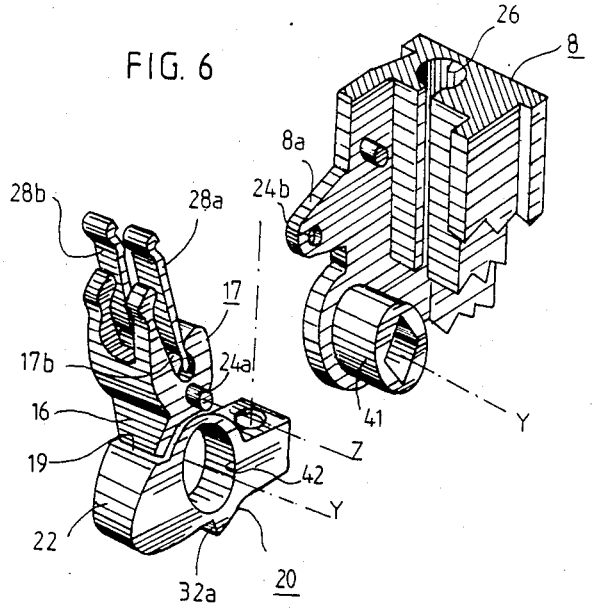
FIG. 6 shows, in a partial perspective view, the elements supported by the drawer.

In the embodiment shown, the contact holder 17, spring 18, piece 20 and spring 21 are supported by the drawer 8 which pivots about the axis YY' placed concentrically to a pin 41 about which pivots a bore 42 of this piece 20, see also FIG. 6; the drawer 8 is itself pivoted in half cases by means of surfaces or means not visible in the Figures.

In the closed position of the drawer, illustrated in FIG. 2, this latter is engaged in the housing 25 of the case and is held in position by means of a resiliently retractable bolt 27.

A thin and insulating screen 13, which is associated by a rod 13*a* with the plunger core 12, may move in a plane RR' substantially parallel to the axis XX' of the coil; this screen has at its end 30, opposite the core, two legs 30*a*, 30*b* which are separated by a groove 40 and are adapted to be engaged on each side of the dividing wall 29. This screen, which is guided with a slight play by this groove in one direction, also receives complementary guiding through the surface 35*a* of the insulating block 35, see FIG. 5, and a groove 35*b* of the dividing wall 29; this guiding orientates the screen so that a movement in direction F in its plane causes the ends of the legs 30*a* and 30*b* to penetrate into two oppositely placed notches with zero or extremely reduced play.

During such movement, the screen passes in the immediate vicinity of the fixed contact pieces 6*a*, 6*b*, see FIG. 2. Finally, the legs 28*a*, 28*b*, or one of them, has a boss 15 which is placed in the immediate vicinity of the heel portion 15*a*.

When the apparatus is used in its function as disconnecting switch, an angular movement communicated to drawer 8 in the alpha direction, causes the contact holder 17 to move and so the mobile contact bridge 28 until the surfaces 32, 32*a* come into contact. In this position, in which the contact bridge is well disengaged from the fixed contacts, accidental contact with the bridge which is then perfectly visible and isolated, presents no danger for the user.

When the apparatus fulfills its function as automatic safety switch, i.e. when a short circuit current flows between the terminals, the plunger core 12, which is instantaneously attracted towards the center of coil 11, communicates a very rapid movement to screen 13. During the movement of this latter in direction J, the boss or bosses 15 raise the heel portion 15*a* of the contact holder 17 while communicating to this latter an angular movement which releases the nose portion 16 of stop 19.

Piece 20, thus tripped, then effects a clockwise movement through release of spring 21 which causes the nose portion to cooperate with the inclined ramp 22 and to cause the contact holder to move rapidly, in the same direction as before, which takes place in the direction of separation of the mobile contacts and the fixed contacts.

It will be noted that the contact bridge 28 is associated with limited play with the contact holder 17 through rocking means 17*b* and a finger 15*b*. Depending on the value of this play, these means cause first of all the contact bridge to be separated very rapidly from the fixed contacts and then to cause this opening to be confirmed by the quick trip device 14, which comprises more especially piece 20 and spring 21. The relative positions of the edges 30*a*, 30*b* of the screen and of bosses 15, as well as that of the mobile contacts 7*a*, 7*b* and of the heel portion 15*a* are chosen so that the end of the screen is placed between the contacts as soon as opening thereof allows it and causes the arc, which is formed at that moment, to be sheared at the entrance of grooves 31*a*, 31*b*.

During this movement, the edges 30*a*, 30*b* of this screen may be engaged in these grooves and may reach an endmost working position T before coming resiliently back to the starting position I (see FIG. 2). For this, the bottoms of grooves 31*a* and 31*b* are connected to channels or vents which connect them to the atmosphere and thus allow the gases released during shearing of the arc not to brake the movement and not to subject the case to an excessive stress. Because of the grooves and the baffles of the case, which are not shown, the lateral edges 13*c*, 13*b* of the screen (see FIG. 5) move while causing, at least temporarily, complete isolation between the two spaces placed on each side of the screen. The space containing the mobile contact may also be connected to the atmosphere through a vent dimensioned so as to prevent an overpressure from opening the drawer.

With the resilient engagement of the screen, which avoids giving thereto a stable working position, a resetting device can be dispensed with and this engagement in no wise affects the quality of the cut off, for meantime the mobile bridge has taken up a very distant stable position O, shown with a broken line in FIG. 2, when surface 32*a* arrives against the fixed surface 32.

Reclosure of switch 5 is provided first of all by a movement in direction alpha, which is communicated to the drawer for resetting piece 20, and then by moving the drawer back into its housing.

During the first movement, piece 20, which is in abutment against the case through the cooperation of surfaces 32*a*, 32, remains fixed, whereas the contact holder 17 is driven. The relative movement between ramp 22 and nose piece 16 brings this latter from the top 22*a* of the ramp against which it was located towards a stop 19 against which locking is caused through the action of spring 18; during this same movement a spring 21 which is housed in a compartment 26 of a drawer is compressed between this latter and arm 20*a*.

Figure 1B:
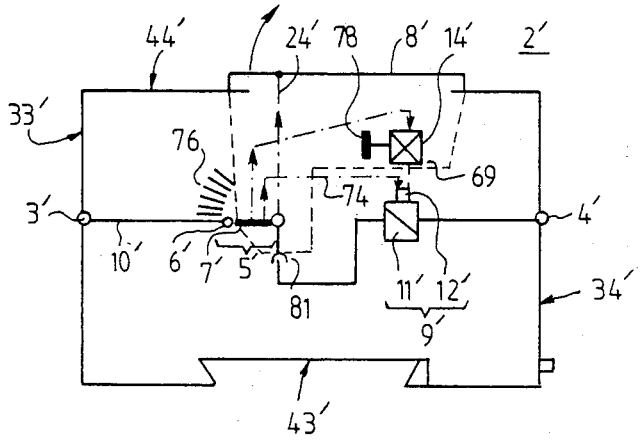

A second apparatus 1*b* in accordance with the invention, which is shown in FIG. 1*b*, comprises a case 2' having a front face 44' and a rear face 43' provided for example with securing means cooperating with standardized shaped sections. Between two current input and output terminals 3', 4' placed in the vicinity of faces 33', 34', is disposed an electric circuit 10' comprising in series; a switch 5' having a mobile contact 7' and a fixed contact 6', and a removable electric coupling device 81 adapted to connect the mobile contact to an automatic opening device 9' comprising a coil 11' cooperating with a magnetizable core or plate 12' adapted to strike the mobile contact 7' so as to cause instantaneous opening of the switch when a high over current flows in the circuit; a deformable resilient mechanism 14', tripped by the core 12', serves for confirming opening of the mobile contact by maintaining it in a position spaced apart from the fixed contact.

A drawer 8', moveable over the front face 44', has coupling means 24' which allow it to cause voluntary opening of switch 5' by acting on the mobile contact 7'; when it is open, this same drawer makes the position of this mobile contact visible so that the user can be sure that the line is electrically isolated and can reset device 14' when this latter has been tripped automatically.

Figure 7:
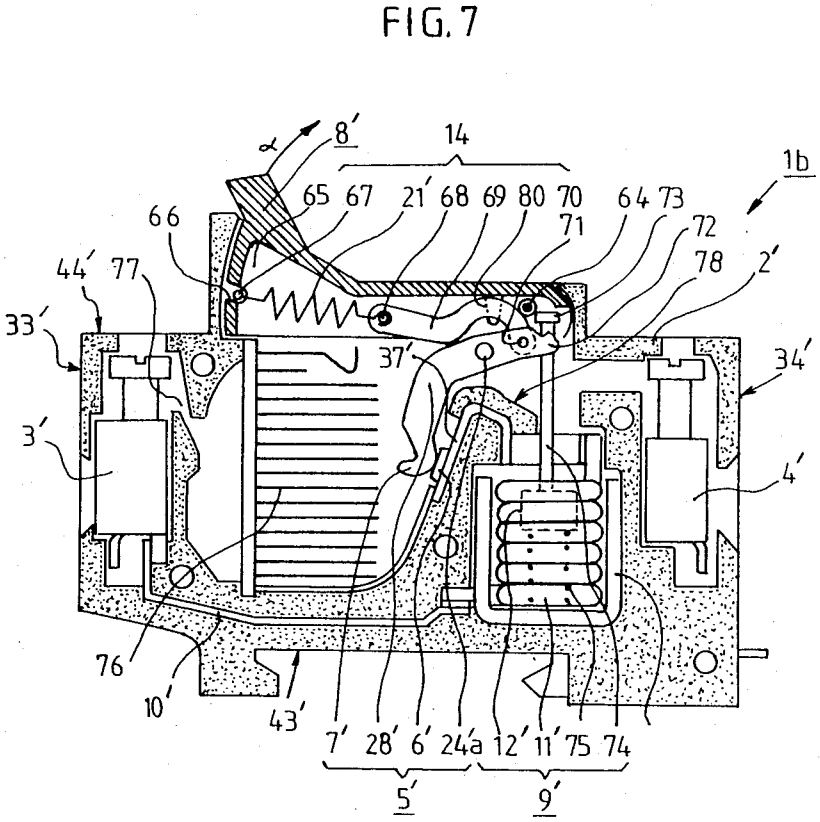
FIG. 7 illustrates a second embodiment of the switch according to the invention in an elevational view and in section through a median plane, where the switch is closed.

One embodiment of the apparatus shown in FIG. 1*b* is illustrated in detail in FIG. 7 where the same references represent parts having the same functions. Circuit 10' extends from terminal 3' to terminal 4' by passing through the coil 11' which is then connected to a conductor 37' carrying the fixed contact 6', then through the single mobile contact 7' which is placed at the end of a contact lever 28 pivoting about a pin 24'*a*, and through two parallel return conductors such as 60 and 60' which receive the pivot pin 24*a* and which end at terminal 4', see also FIG. 8.

Figure 10:
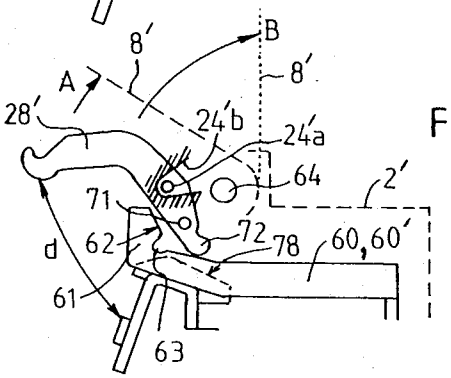

For this, each of conductors 60, 60' has the shape of an L in the inner angle of which is placed an open notch 63 adapted to receive one of the ends of pivot pin 24'*a* and whose short leg 61 has an inclined surface 62, see in particular FIG. 10. When the switch apparatus 1*b* is in the condition shown in FIGS. 7 and 8 where the drawer 8' which pivots about a shaft 64 is closed, the ends of pivot pin 24'*a* are each placed, with play, in V-shaped grooves 24'*b* belonging to the drawer. The axis of this pivot pin is separate from the pivoting shaft 64 of drawer 8'.

Inside the pivoting drawer is enclosed a volume 65 insulated from the outside and in which is placed a traction spring 21'having a fixed end 67, engaged in a bracket 66 of the drawer and a mobile end 68 which is connected to a link 69; this latter has a fastening point 70 which is opposite end 68 and which connects it to a point 71 of the contact lever 28' distant from pivot pin 24'*a*.

In the closed condition of switch 5' which can be seen in FIG. 7, spring 21' communicates to lever 28' an anticlockwise torque which causes the mobile contact 7' to press against the fixed contact 6'. One end 72 of the contact lever 28, which may locally have the shape of a fork, is placed, when the switch is closed, in the vicinity of a head 73 representing the end of a rod 74 connected to the plunger core 12' of the coil 11'; this plunger core is held in its upper rest position in FIG. 7 by means of a spring 75. An abutment surface 78, whose role will become clearer further on, is placed opposite the end 72 of lever 28' but on the side opposite head 73 and with a certain clearance.

Finally, an arc extinction chamber 76, which is placed opposite the cut off zone of switch 5', communicates with the outside through vents such as 77. The members 21', 28', 69, 70, 24'*b*, 79 and 80 form the elements of the deformable and resettable resilient mechanism shown at 14' in FIG. 1*b*.

Figure 8:
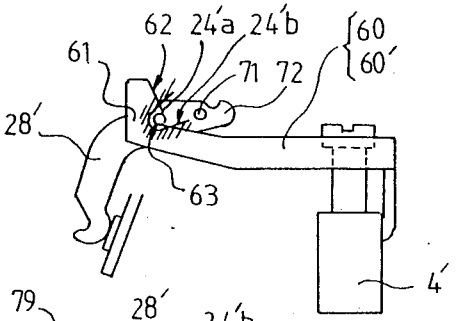
FIG. 8 shows in elevation a constructional detail of the removable coupling means between the contact lever of the switch, here in the closed position, and one of the connecting terminals.
Figure 9:
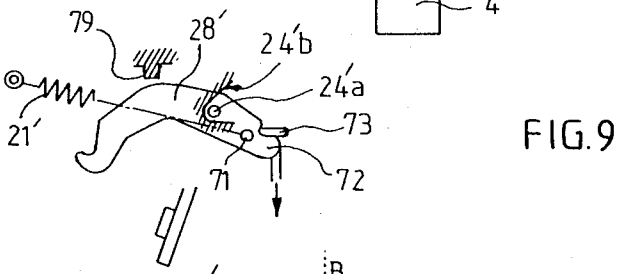
FIGS. 9 and 10 show in detail two successive phases of automatic opening of the switch.

The operation, which is shown in FIGS. 8, 9 and 10, begins when the switch is closed, FIGS. 7 and 8. An excessive current flowing in the circuit 10' causes the instantaneous attraction of a core 12' which compresses the return spring 75 and causes head 73 to strike against the end 72 of lever 28', which causes this latter to pivot instantaneously in a clockwise direction and so causes switch 5' to open. During this movement, the points 70, 71 move beyond a straight line passing through pivot pin 24'*a* and through point 67 while loading the spring 21'; this movement, which is made possible because link 69 passes round this pivot pin, ends when lever 28', in abutment against an abutment surface 79 of the drawer, see FIG. 9, takes up a stable position which confirms the automatic opening of the switch.

When, for resetting mechanism 14', the drawer is opened by hand in the alpha direction, grooves 24'*b* come into contact with the ends of the pivot pin 24'*a* and take it with them while releasing it from notches 63, which isolates lever 28' from terminal 4', see the drawer shown in broken lines in position A of FIG. 10. The contact lever 28' which has just been described is thus connected electrically to terminal 4' and mechanically to the conductors 60, 60' in the closed position of the drawer through a removable coupling, referenced 81 in FIG. 1*b*, which releases it in the open position of the drawer.

A further rotation of the drawer 8', which brings it to position B with a dotted line in FIG. 10, brings first of all the end 72 of the contact lever 28° against an abutment surface 78, belonging for example to case 2', which secures this lever against movement; further movement of the drawer to position B then causes the engagement point 67 of spring 21' to pass on the right hand of a line passing through the pivot pin 24'*a* and point 71, so that link 69 now transmits to lever 28' an anticlockwise torque which communicates thereto a rotation in the same direction until it meets a stop 80 placed in the drawer 8', see FIG. 7.

This latter movement, which signals that resetting of mechanism 14' is finished, brings lever 28' into an angular position which is more advanced with respect to the drawer than that shown in FIG. 7 so that the contact pressure is established as soon as the mobile contact comes into abutment against the fixed contact an reclosure of the of the drawer. In position B, the switch apparatus has the function of a disconnecting switch in which the electric connection piece, namely the mobile contact 7', is separated from the fixed contact 6' by a large distance "d"; moreover, the mobile contact is made visible, which forms for the user a guarantee that this disconnecting operation has in fact been accomplished; moreover, since lever 28' is separate from the other conducting parts 60, 60', accidental contact with this lever presents no danger. During reclosure of drawer 8', the ends of the pivot pin 24'*a* are opposite the inclined surfaces 62 and slide thereover until they are opposite notches 63, into which they then penetrate; the ends of pivot pin 24'*a* are again separated from grooves 24'*b* when the drawer reaches its closure position.

The stability of the engagement of pivot pin 24'*a*, either in notches 63, or in the grooves 24'*b*, is due to the fact that these latter are open in a direction opposite the engagement point 67 of spring 21'.

Figure 1C:
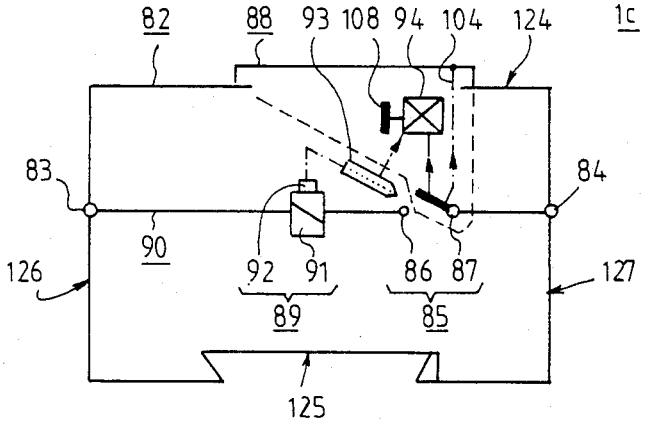

A third apparatus 1*c* in accordance with the invention, which is shown schematically in FIG. 1*c*, comprises a case 82 having a front face 124 and a rear face 125 with for example securing means cooperating with standardized shaped sections.

Between two current input and output terminals 83, respectively 84, placed in the vicinity of the lateral faces 126, respectively 127, is disposed an electric circuit 90 comprising in series: a switch 85 having a movable contact 87 and a single fixed contact 86, and an automatic opening device 89 comprising a coil 91 cooperating with a magnetizable core or plate 92 adapted to cause quick tripping of a resilient device 94 for rapid opening of the mobile contact when the coil has a large over current flowing therethrough; an insulating screen 93, adapted to be placed rapidly between the contacts as soon as they open, is associated with core 92 and further serves as a member for transmitting movment between this latter and the resilient quick trip device 94.

A drawer 88, mobile on the front face, comprises, with the mobile contact, coupling means 103, 104 which allow it to voluntarily open the switch 85; when it is open, this same drawer makes the position of this mobile contact visible so that the user can be sure that the line is electrically isolated. Referring to FIG. 11, which shows a particular embodiment of FIG. 1*c* where a single pole switch is disposed in a modular case of small width, terminals 83, 84 are placed in a median plane which is that of the Figure parallel to two lateral faces separated by a small thickness "e". As in the preceding embodiments, the same switch, which is here in its closed position, is used for providing automatic opening or voluntary disconnecting opening of the line. Between two half cases, such as 123*a*, 123*b* forming case 82 after association, see FIGS. 14 and 11, are held in place in a lower region;

the terminals 83, 84;

a magnetic yoke 112 which cooperates with coil 91 and a mobile coil 92 associated with a fork transmission piece 129;

a transmission lever 130 having one end 114 pivotably mounted in an extension 128 of the yoke, an association pin 116 placed in the fork, and a return spring 117 holding the core in the rest position;

an insulating screen 93 adapted to move substantially parallel to the axis of the coil in grooves for guiding the half cases 123*a* 123*b* such as 131*a*, 131*b*, see FIG. 14;

a pivoting drawer 18 movable, by means of a pivot pin 120, about an axis ZZ' perpendicular to the plane of the Figure; and conductors such as 132 and 113 connect the coil to terminal 83 and respectively to the fixed contact 86, see also FIG. 12.

In an internal volume 133 of drawer 88, which is directed towards the coil, is placed a contact lever 97 supporting a pivot pin 104 adapted for pivoting about an axis VV' and for sliding in oblong grooves in this drawer such as 103 (see FIG. 12); this lever has a first arm 134 at the end of which is located the mobile contact 87, a second arm 135 which is connected by a flexible braided conductor 119 to terminal 84 and a third arm 136 which is placed in the vicinity of the first one and which has at its end a retaining notch 96. A contact pressure spring 100 (see FIGS. 13 and 14) is disposed concentrically to the pivot pin 104 and has a fixed end 98, which is engaged in the drawer and a mobile end 101, which is engaged in a notch 102 in lever 97 so as to communicate thereto a resilient clockwise torque J. Between arms 134 and 136 is to be found a substantially radial gap 137 whose function will be explained below. A holding link 106, which is for example made from a metal wire and has the shape of a U, see FIG. 14, comprises legs with bent back ends 105 which are pivotably mounted in the drawer 88 and has a portion 99 parallel to the pivoting axis serving as a hook when this latter is engaged in the retaining notch 96 (see FIG. 13). This link is subjected to a small resilient return force K, in an anticlockwise direction, by means which have not been shown so as not to overload the Figures.

Because of the direction of force J, the clearance existing between the pivot pin 104 and the groove 103, the respective position of the pivoting axes of the pivot pin 104 and the bent back ends 105, as well as the substantially parallel positions of the third arm 136 and of the link 106, see FIG. 13, the engagement point 99, 96 were lever 97 is retained by link 106, plays the role of a pivoting axis for this lever 97, and this latter is subjected to a resulting anticlockwise force which causes the force R of the mobile contact 87 pressing against the fixed contact 86 when the switch and the drawer are both closed.

If drawer 88 is given an open position by pivoting in the alpha clockwise direction, lever 97 will first of all pivot slightly in the anticlockwise direction about the engagement point 96, 99 until the pivot pin 104 meets the left hand end 103*g* of groove 103, then will be driven by the drawer 88 until lever 97 meets a stop or reaches a particular balanced position in which disconnecting is caused. During this voluntary opening movement, which causes disconnection of the electric line concerned, a curved transparent wall 109 of the drawer will slide along a parallel wall 138 of the case without being however completely released therefrom.

There is then no danger that the user will accidently come into contact with a live part, and the user still has the possibility of examining in direction G the position of the contact lever 97 and that of the mobile contact 87 so as to make sure that disconnection of the line has been carried out.

When opening of the switch is caused automatically by the appearance of a short circuit, one end 118 of the transmission lever 130 will strike one end 122 of the oppositely placed screen 93 (see FIGS. 11 and 12) because of the attraction of core 92; during this movement, a boss 95 formed on the screen, frees hook 99 from notch 96, which releases the contact lever 97 and substitutes for the pivoting point 99, 96 a mobile pivoting pin which is situated in the oblong groove 103.

Under the effect of force J, lever 97 thus begins to rotate very rapidly in a clockwise direction, which on the one hand, will cause the instantaneous opening of switch 85 and will allow, on the other hand, the left hand 105 of the screen to pass between the contacts so as to cause first of all cooling of the arc and, in cooperation with an edge of a groove 134 of the case, placed oppositely, shearing thereof, see FIG. 12. Vents such as 110, 111 shown in FIG. 11 connect this groove 134 and/or the upper and lower striking regions of the arc to the outside atmosphere.

The rapid rotation of the contact lever 97, which is made possible because, after separation from notch 96, the hook 99 is positioned in gap 137, ends when the lever comes into abutment for example against a bearing surface 108 belonging to the case and penetrating into the internal volume 133. Resetting of the device is achieved by pivoting the drawer in the alpha direction, in a clockwise direction, which is made possible because of the presence of an open groove 107 surrounding the bearing surface 108 in the lateral wall of the drawer.

During this resetting operation, region 121 of lever 97 remains substantially motionless whereas the pivot pin 104, which is driven by the groove 103, travels over an angular path giving, to the contact lever and to the drawer, respective positions such that the hook 99 may snap into notch 96. When the drawer is then subjected to a closure movement in the opposite direction, cooperation between region 121 and bearing surface 108 is interrupted, but lever 97 is held by the hook 99 and by the left hand bottom 103*g* of groove 103, so that further movement of the drawer brings the assembly of parts contained by the drawer back to the position of FIG. 11.

As in the embodiment shown in FIG. 2, the screen does not need to be reset because of the presence of a weak return spring, not visible in the Figures, which allows it to follow the movements of lever 130; it is also possible to associate together screen 93 and the end 118 of this lever 130 by surfaces cooperating in both directions.

In the embodiments illustrated it is possible to associate several cases, for example three, side by side so as to form a multipolar apparatus; in this case recessed portions, for example with a square section, of the pivots of the drawers may be associated coaxially with ZZ' so as to cause simultaneous disconnection of several phase conductors.

The angular paths travelled over by the drawers and by the movable contacts of these apparatus are chosen so that the disconnecting distances "d" laid down by norms for the categories of use envisaged, are respected.

It should be moted that the transparent part 109 of drawer 88 is located in the upper part thereof in the embodiments of FIGS. 11 and 12. At least one of the lateral faces of the drawer may be transparent, or the whole drawer may be integrally moulded of a transparent material. The pivoting axis of the pivoting drawer is advantageously located at a certain distance of the rear face of the case, thus allowing the device provided with a coil and a magnetizable piece to be lodged between said axis and the rear face of the drawer, the fixed and the movable contacts being located at the front of said device. The visibility of the movable contact is thus improved.

What is claimed is:

1. An electric switch apparatus for protecting an electric circuit, said apparatus comprising:

a case having an opening, an input terminal and an output terminal;

a pivoting drawer rotatably mounted about a first pivot pin rigidly connected to the case and adapted to be manually pivoted between a first position in which said opening is closed and a second position in which said opening is opened;

an electric circuit connected between said terminals and comprising a switch having two fixed contacts rigidly mounted on said case and connected to said terminals by two respective connecting circuits mounted in said case, and a mobile contact bridge having two contact elements and rotatably mounted about a second pivot pin rigidly connected on said drawer and spaced from said first pivot pin, so that, when said drawer is in its first position, said mobile contact bridge can be moved from a third position, wherein said contact elements are respectively engaged against said two fixed contacts to a fourth position, wherein the two contact elements are separated from the two fixed contacts by a first distance and when said drawer is in its second position, the two contact elements are separated from the two fixed elements by a second distance greater than the first distance, one of said two connecting circuits comprising a coil rigidly mounted in said case and provided with a mobile magnetizable core and guiding means rigidly mounted in said case being provided to guide said core in a predetermined direction;

a tripping mechanism having a cocked and a released position, and comprising:

a control element mounted in the drawer, having a cocked and released position and locking means;

actuation means cooperating with a spring both mounted in the drawer and adapted to pass from a cocked position corresponding to the cocking position of the control element and in which said actuation means compresses said spring and is locked by said locking means, to a released position when said control element is passing from the cocked position to the released position under the action of releasing forces, and to pass from the released position to the cocked position under a cocking force antagonist to the action of the said spring;

a first mechanical linkage between said movable core and said control element, to transmit on said control element a releasing force exerted on said control element by said core when said coil is traversed by an overcurrent;

a second mechanical linkage between said actuation means and said mobile contact bridge, to move said mobile contact bridge from its third position to its fourth position when said actuation means pass from the cocked position to the released position;

a third mechanical linkage between said case and said actuation means and adapted to apply said cocking force on said actuation means when the drawer is passing into its second position.

2. An electric switch according to claim 1, in which:

said actuation means comprise an actuation element rotatably mounted about said first pivot pin, said actuation element having a caming surface and first, second and third abutment surfaces, said first abutment surface being urged by said spring;

said control element and said second mechanical linkage comprise a rocking contact holder rotatably mounted about said second pivot pin and having securing means in which said contact bridge is held and first and second levers, said first lever having a fourth abutment surface adapted to engage said second abutment surface to stop the rotational movement of said actuation element in said cocked position of said control element and said actuation means and to release said actuation element upon a first rotational motion of the contact holder which causes said second abutment surface to be disengaged from said fourth abutment surface and therefor said actuation element to be rotated in a second rotational motion under the action of said spring with said mobile contact bridge passing from said third position to said fourth position;

said first mechanical linkage comprises a first abutment element connected to said core and adapted to cooperate with a corresponding fifth abutment surface of said second lever so as to transmit said releasing force on said second lever to cause said first rotational movement of the contact holder when said coil is traversed by an overcurrent, and said third mechanical linkage comprises a second abutment element formed in said case and against which said third abutment surface is bearing in the released position of said actuation means so that said second abutment element applies said cocking force on said actuation element when said drawer is passing from said first position to said second position.

3. An electric switch according to claim 2, in which said securing means comprises means to hold said contact bridge with angular clearance, said electric switch further comprising a second spring disposed between said drawer and said contact bridge.

4. An electric switch according to claim 2, further comprising an insulating screen which is connected to said core and guiding means adapted to guide said screen and to cause the same to pass between said fixed contacts and said mobile contact bridge when said coil is traversed by an overcurrent, said screen bearing said first abutment element.

5. An electric switch according to claim 1, in which said drawer is at least partially transparent.

* * * * *